US009322244B2

(12) United States Patent
Hallundbæk et al.

(10) Patent No.: US 9,322,244 B2
(45) Date of Patent: Apr. 26, 2016

(54) INFLOW ASSEMBLY

(75) Inventors: Jørgen Hallundbæk, Græsted (DK); Tomas Sune Andersen, Helsingør (DK)

(73) Assignee: WELLTEC A/S, Allerød (DK)

( * ) Notice: Subject to any disclaimer, the term of this patent is extended or adjusted under 35 U.S.C. 154(b) by 355 days.

(21) Appl. No.: 13/994,959

(22) PCT Filed: Dec. 16, 2011

(86) PCT No.: PCT/EP2011/073099

§ 371 (c)(1), (2), (4) Date: Jun. 17, 2013

(87) PCT Pub. No.: WO2012/080485

PCT Pub. Date: Jun. 21, 2012

(65) Prior Publication Data

US 2013/0277043 A1 Oct. 24, 2013

(30) Foreign Application Priority Data

Dec. 17, 2010 (EP) ..... 10195562

(51) Int. Cl.
*E21B 34/14* (2006.01)
*E21B 21/10* (2006.01)

(52) U.S. Cl.
CPC ..... *E21B 34/14* (2013.01); *E21B 21/103* (2013.01)

(58) Field of Classification Search
CPC ..... E21B 34/14; E21B 34/00; E21B 34/06; E21B 34/12; E21B 21/10; E21B 21/103
See application file for complete search history.

(56) References Cited

U.S. PATENT DOCUMENTS

| | | | | |
|---|---|---|---|---|
| 2,710,655 | A | 6/1955 | Haskell | |
| 3,993,130 | A * | 11/1976 | Papp | 166/330 |
| 4,162,705 | A * | 7/1979 | Daigle | 166/186 |
| 4,315,542 | A * | 2/1982 | Dockins, Jr. | 166/117.7 |
| 4,782,896 | A * | 11/1988 | Witten | 166/116 |
| 6,883,613 | B2 | 4/2005 | Bode et al. | |
| 2003/0047702 | A1 | 3/2003 | Gunnarsson et al. | |

(Continued)

FOREIGN PATENT DOCUMENTS

| | | |
|---|---|---|
| RU | 92905 U1 | 4/2010 |
| WO | WO 01/86113 | 11/2001 |

OTHER PUBLICATIONS

Notification Concerning Transmittal of International Preliminary Report on Patentability and Written Opinion for corresponding PCT/EP2011/073099, issued Jun. 18, 2013, 9 pages.
International Search Report for PCT/EP2011/073099 mailed Feb. 15, 2012.

(Continued)

*Primary Examiner* — Yong-Suk (Philip) Ro
(74) *Attorney, Agent, or Firm* — Nixon & Vanderhye P.C.

(57) ABSTRACT

An inflow assembly for controlling fluid flow between a hydrocarbon reservoir and a production casing in a well, comprising a first tubular having an axial extension and at least one inlet and a first wall with at least a first axial channel extending in the first wall from the inlet, a second tubular having a first and a second end and at least one outlet, the second tubular being rotatable within the first tubular and having a second wall with at least a second axial channel extending in the second wall from the first end to the outlet. The assembly is configured to control a fluid flow between a hydrocarbon reservoir and a production casing in a well. The inflow assembly may also be utilized in a downhole completion comprising a casing string.

13 Claims, 9 Drawing Sheets

(56) References Cited

U.S. PATENT DOCUMENTS

| | | | | |
|---|---|---|---|---|
| 2006/0124310 | A1* | 6/2006 | Lopez de Cardenas et al. | 166/313 |
| 2008/0029265 | A1* | 2/2008 | LaClare et al. | 166/217 |
| 2008/0041582 | A1 | 2/2008 | Saetre et al. | |
| 2009/0044955 | A1* | 2/2009 | King et al. | 166/374 |
| 2009/0133869 | A1* | 5/2009 | Clem | 166/250.15 |

OTHER PUBLICATIONS

Written Opinion of the International Searching Authority mailed Feb. 15, 2012.

Decision to Grant issued Dec. 4, 2015 in a corresponding Russian Patent Application No. 2013132390/03(048419) (8 pages).

* cited by examiner

INFLOW ASSEMBLY

This application is the U.S. national phase of International Application No. PCT/EP2011/073099 filed 16 Dec. 2011 which designated the U.S. and claims priority to EP 10195562.3 filed 17 Dec. 2010, the entire contents of each of which are hereby incorporated by reference.

FIELD OF THE INVENTION

The present invention relates in an aspect to an inflow assembly for controlling fluid flow between a hydrocarbon reservoir and a production casing in a well, comprising a first tubular having an axial extension and at least one inlet and a first wall with at least a first axial channel extending in the first wall from the inlet, a second tubular having a first and a second end and at least one outlet, the second tubular being rotatable within the first tubular and having a second wall with at least a second axial channel extending in the second wall from the first end to the outlet.

The invention further relates in another aspect to an assembly for controlling fluid flow between a hydrocarbon reservoir and a production casing in a well, comprising a first tubular having at least a first and a second inlet, a second tubular rotatable within the first tubular, having a wall and an outlet penetrating the wall. The invention also relates to a downhole completion.

BACKGROUND ART

For controlling fluid flow between a hydrocarbon reservoir and a production casing in a well, it is desirable to open and/or close different inflow openings along the casing string.

This may for instance be performed by arranging a sliding element on the inside of the inflow opening. However, the sliding element may be prevented from sliding since scale and other residues may be deposited in the designated sliding areas, having the consequence that the opening or closing of a specific inflow opening cannot be performed.

A further disadvantage is that one or more inlets may be blocked and hence out of function due to scales and residues.

It also known to use rotating sleeves, which may be rotated in relation to a stationary tubular, the sleeve and the tubular both being provided with openings, wherein the sleeve is rotated until all the openings are aligned. Thus, the prior rotating sleeve solutions are adapted to either open or close all openings at the same time, i.e. they function as an on/off valve.

Furthermore, since the fluid pressure present in the hydrocarbon reservoir is often very high, the known solutions tend to lose their sealing properties, especially when the inflow openings are closed.

SUMMARY OF THE INVENTION

It is an object of the present invention to wholly or partly overcome the above disadvantages and drawbacks of the prior art. More specifically, it is an object to provide an improved inflow assembly for controlling fluid flow between a hydrocarbon reservoir and a production casing in a well.

The above objects, together with numerous other objects, advantages, and features, which will become evident from the below description, are accomplished by a solution in accordance with the present invention by an inflow assembly for controlling fluid flow between a hydrocarbon reservoir and a production casing in a well, comprising a first tubular having an axial extension and at least one inlet and a first wall with at least a first axial channel extending in the first wall from the inlet, a second tubular having a first and a second end and at least one outlet, the second tubular being rotatable within the first tubular and having a second wall with at least a second axial channel extending in the second wall from the first end to the outlet, wherein the second tubular is rotatable in relation to the first tubular at least between a first position, in which the first and second channels are in alignment for allowing fluid to flow from the reservoir into the casing via the first end of the second tubular and a second position, in which the first and second channels are out of alignment so that fluid is prevented from flowing into the casing.

In one embodiment, a first packer may be arranged between the first tubular and the first end of the second tubular, the packer having at least one through-going packer channel aligned with the first axial channel.

The first packer may be made of ceramics.

One advantage of said first packer being made of ceramics is that it allows for a smooth surface providing excellent sealing, as the surface may be pressed closer to the opposite surface.

Further, a first spring element may be arranged between the first packer and the first tubular.

In one embodiment, the spring element may be circular and may be squeezed in between the first packer and the first tubular, pressing the first packer in sealing arrangement with the second tubular.

In another embodiment, the spring element may be circular and may be squeezed in between the first packer and the first tubular, providing a sealing connection with both the first packer and the first tubular.

Said spring element may be ring-shaped having an inner spring diameter which is substantially equal to an inner diameter of the first tubular.

Also, the spring element may comprise at least one hole for providing fluid communication between the first axial channel and the second axial channel.

The at least one hole of the spring element may extend through the spring element along the axial extension of the first tubular.

Moreover, the packer may be ring-shaped having an inner packer diameter which is substantially equal to an inner diameter of the first tubular.

Furthermore, the packer may comprise at least one packer channel providing fluid communication between the first axial channel and the second axial channel.

Additionally, the at least one packer channel of the packer may extend through the packer along the axial extension of the first tubular.

The spring element may be fixedly connected with the first tubular part so that the at least one hole in the spring element is aligned with the first axial channel of the first tubular part.

Also, the spring element may be fixedly connected with the first tubular part and the first packer so that the at least one hole in the spring element is aligned with the first axial channel of the first tubular part and the at least one hole in the first packer is aligned with the at least one hole in the spring element and the first axial channel of the first tubular part.

Further, the spring element may be bellows-shaped, and it may be made of metal.

In an embodiment, the bellows-shaped spring element may have a first outer face abutting the first tubular providing a sealing connection with the first tubular so that fluid flows in the first axial channel of the first tubular through the hole in the spring element.

Furthermore, the bellows-shaped spring element may comprise recesses, in which the fluid flow can force the spring element against the packer.

This causes the packer to be pressed against the second tubular thus enhancing the sealing properties.

Moreover, the spring element may have a surface area which is larger than a cross-section of the axial recess.

This is advantageous because the fluid exerts pressure on the surface area in order to provide sealing.

In addition, the first tubular may have a second inlet and a third axial channel extending in the first wall from the second inlet, the second tubular having a second outlet and having at least a fourth axial channel extending in the second wall from the second end, the second tubular being rotatable in relation to the first tubular at least between a first position, in which the third and fourth channels are in alignment for allowing fluid to flow from the reservoir into the casing via the second end of the second tubular and a second position, in which the third and fourth channels are out of alignment so that fluid is prevented from flowing into the casing from the second end of the second tubular.

Also, a second packer may be arranged between the first tubular and the second end of the second tubular, the packer having at least one through-going packer channel aligned with the third axial channel.

Additionally, a second spring element may be arranged between the second packer and the first tubular. Hereby is obtained that pressure is exerted on both sides of the second tubular, providing excellent sealing on both sides.

Furthermore, the first tubular may comprise a plurality of inlets and/or a plurality of first axial channels.

In addition, the second tubular may comprise a plurality of second axial channels.

The packer may comprise a plurality of packer channels, preferably the same number of first and/or third axial channels.

A valve may be arranged in one or more inlet(s), preferably an inflow control valve.

Further, a throttle may be arranged in one or more inlet(s).

Also, a screen may be arranged outside the first tubular opposite the inlet.

Said screen may be rotatable or slidable.

Moreover, the second tubular may comprise at least one recess accessible from within, the recess being adapted to receive a key tool for rotating the second tubular.

Axial channels may be provided on both sides of the second tubular, rendering one rotatable tubular capable of handling inflow through several inlets/valves.

The present invention also relates to an assembly for controlling fluid flow between a hydrocarbon reservoir and a production casing in a well, comprising a first tubular having at least a first and a second inlet, a second tubular rotatable within the first tubular, having a wall and an outlet penetrating the wall, wherein the second tubular is rotatable from a first position in which the outlet is aligned with the first inlet and the wall is opposite the second inlet to a second position in which the outlet is aligned with the second inlet and the wall is opposite the first inlet, or to a third position in which the wall is opposite the first and the second inlets.

In one embodiment, the first tubular may comprise a plurality of inlets.

Further, the second tubular may comprise a plurality of outlets so that several inlets and outlets can be in alignment.

The second tubular may comprise at least one recess accessible from within, the recess being adapted to receive a key tool for rotating the second tubular.

Finally, the present invention relates to a downhole completion comprising a casing string and one or more of the inflow assembly/assemblies described above.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
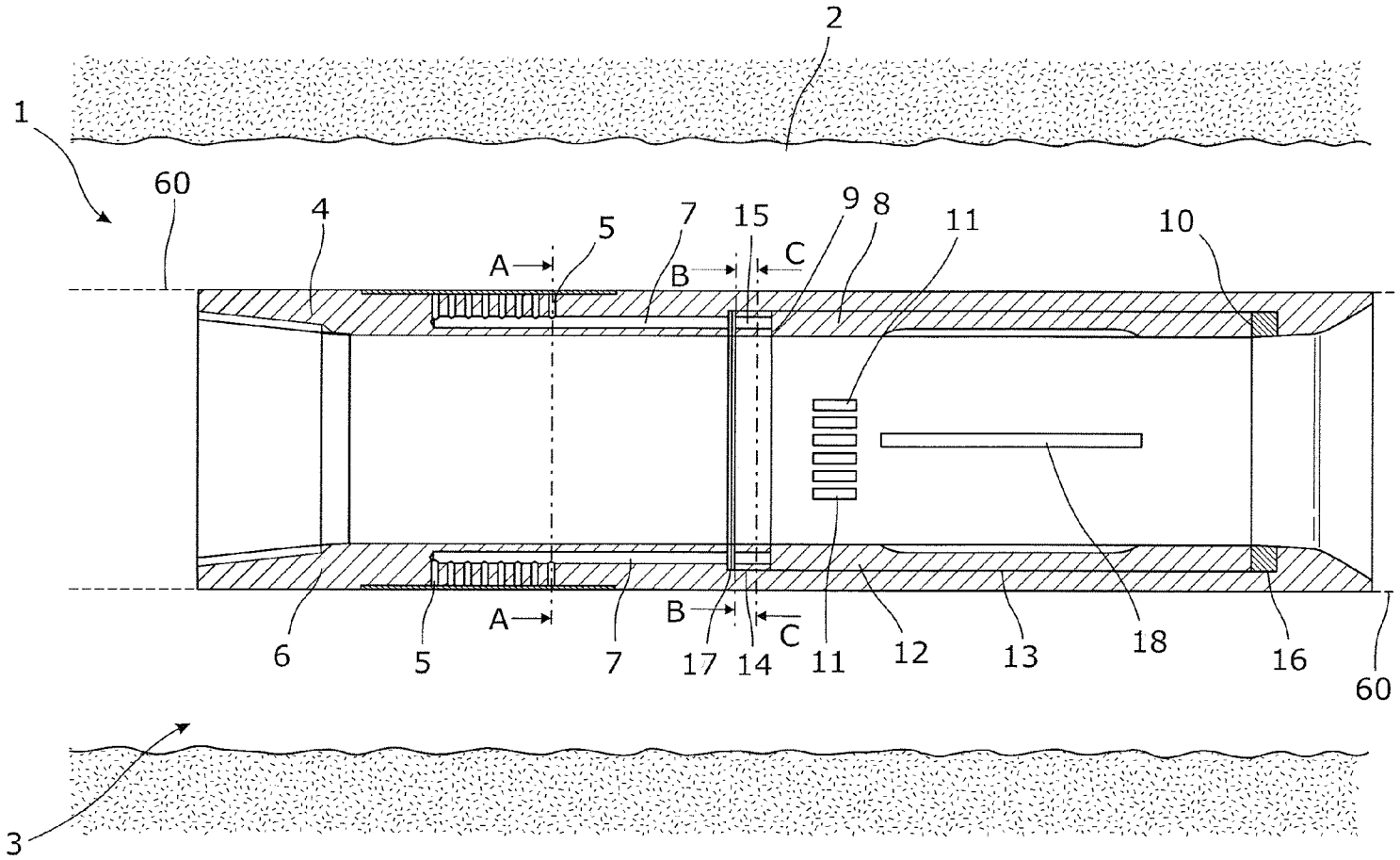
FIG. 1 shows a longitudinal cross-sectional view of an inflow assembly according to the invention.

FIG. 1 shows a longitudinal cross-sectional view of an inflow assembly 1 for controlling fluid flow between a hydrocarbon reservoir 2 and a production casing in a well 3.

The inflow assembly comprises a first tubular 4 having twelve inlets 5 and a first wall 6 having twelve first axial channels 7 extending in the first wall 6 from the inlets 5. By axial channels is meant that the channels extend in an axial direction in relation to the inflow assembly.

The inflow assembly 1 also comprises a second tubular 8 having a first end 9 and a second end 10 and, in this view, six outlets 11. Even though the second tubular only shows six outlets 11, the number of outlets is actually the same as in the first tubular 4, i.e. 12 outlets.

Furthermore, the second tubular 8 is rotatable within the first tubular 4, and has a second wall twelve having twelve second axial channels 38 extending in the second wall 12 from the first end 9 to the outlet 11. Thus, each outlet has its own second axial channel.

The second tubular is arranged in an inner circumferential recess 13 in the first wall 6 of the first tubular 4 so that when the second tubular 8 is arranged in the recess, the second tubular 8 will not decrease the overall inner diameter of the inflow assembly and thereby the casing string 60.

The second tubular 8 is rotatable in relation to the first tubular 4 at least between a first position, in which the first channel 7 and the second channel 38 are in alignment for allowing fluid to flow from the reservoir into the casing via the first end 9 of the second tubular and a second position (the position shown in FIG. 1), in which the first channel 7 and second channel 38 are out of alignment so that fluid is prevented from flowing into the casing.

The inflow assembly 1 also comprises a first packer 14 which is arranged between the first tubular 4 and the first end 9 of the second tubular 8. The packer 14 extends around the inner circumferential recess 13 and has an inner diameter which is substantially the same as that of the second tubular. The packer 14 has the same number of through-going packer channels 15 as there are first axial channels, i.e. in this embodiment twelve, the packer channels 15 being aligned with the first axial channels 7. The packer is fixedly connected with the first tubular so that the packer channels 15 are fluidly connected with first axial channels. The packer is ring-shaped and the through-going packer channels 15 extend through the packer along the axial extension of the first tubular.

The packer 14 is preferably made of ceramics, whereby it is possible to make the contact surfaces of the packer 14 smooth, which enhances the sealing properties of the packer 14, since the smooth contact surface may be pressed closer to the opposite surface which is the first end 9 of the second tubular 8. However, in other embodiments, the packer may be made of metal, composites, polymers, or the like.

Furthermore, a second packer 16 is arranged between the first tubular 4 and the second end 10 of the second tubular 8. However, in another embodiment, the second packer is omitted, whereby the second end 10 of the second tubular 8 faces the first wall of the first tubular 4.

A first spring element 17 is arranged between the first packer 14 and the first tubular 4. The spring element 17 will be described in connection with FIGS. 4 and 5 below.

Furthermore, the second tubular 8 comprises at least one recess 18 accessible from within, the recess 18 being adapted to receive a key tool (not shown) for rotating the second tubular 8 in relation to first tubular 4.

The inflow assembly 1 is adapted to be inserted and form part of a casing string 60 thus forming a cased completion (not shown). Thus, the ends of the inflow assembly 1 are adapted to be connected with another casing element by conventional connection means, for instance by means of a threaded connection.

Figure 2:
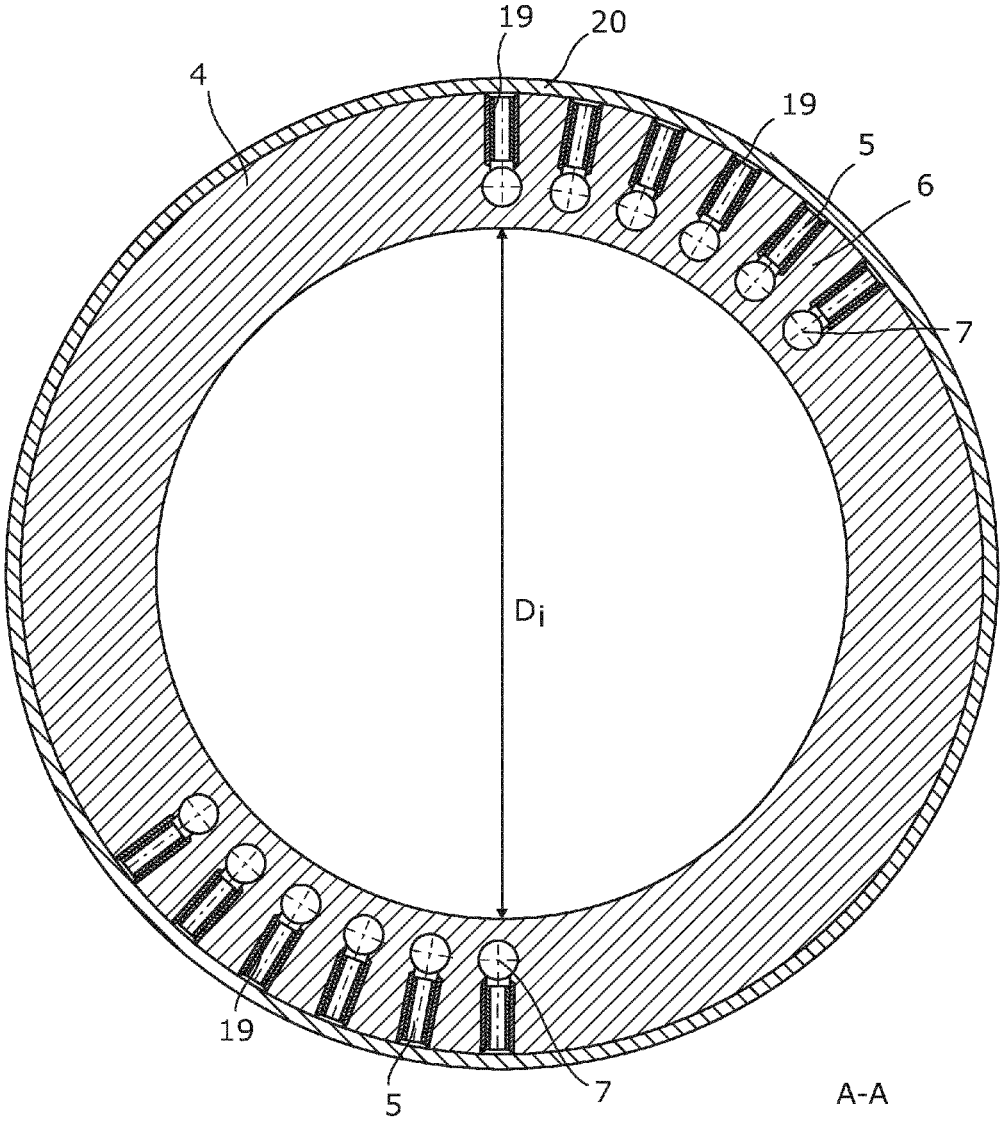
FIG. 2 shows a cross-sectional view of the section taken at A-A.

FIG. 2 shows a cross-sectional view of the first tubular 4 taken at A-A in FIG. 1. The twelve inlets 5 are shown in two groups, each having six inlets. The two groups are positioned diametrically opposed to each other. The inlets 5 extend in a radial direction from the exterior of the first tubular to the first axial channels 7. The first axial channels 7 are extending in the axial direction of the first tubular 4, and are preferably made by drilling the channels in the first wall 6. In this embodiment, flow restrictors 19 are arranged in the inlets 5 for restricting or throttle the inflow of fluid into the first channels 7. The flow restrictors 19 may be hard metal inserts.

In another embodiment, other flow restrictors or valves may be arranged in the inlets 5.

Furthermore, a screen 20 is arranged around the inlets 5 for protecting the inlets 5, as well as the flow restrictors and valves arranged in the inlets, when the inflow assembly is not in operation. The screen 20 may be rotatable or slidable.

Figure 3:
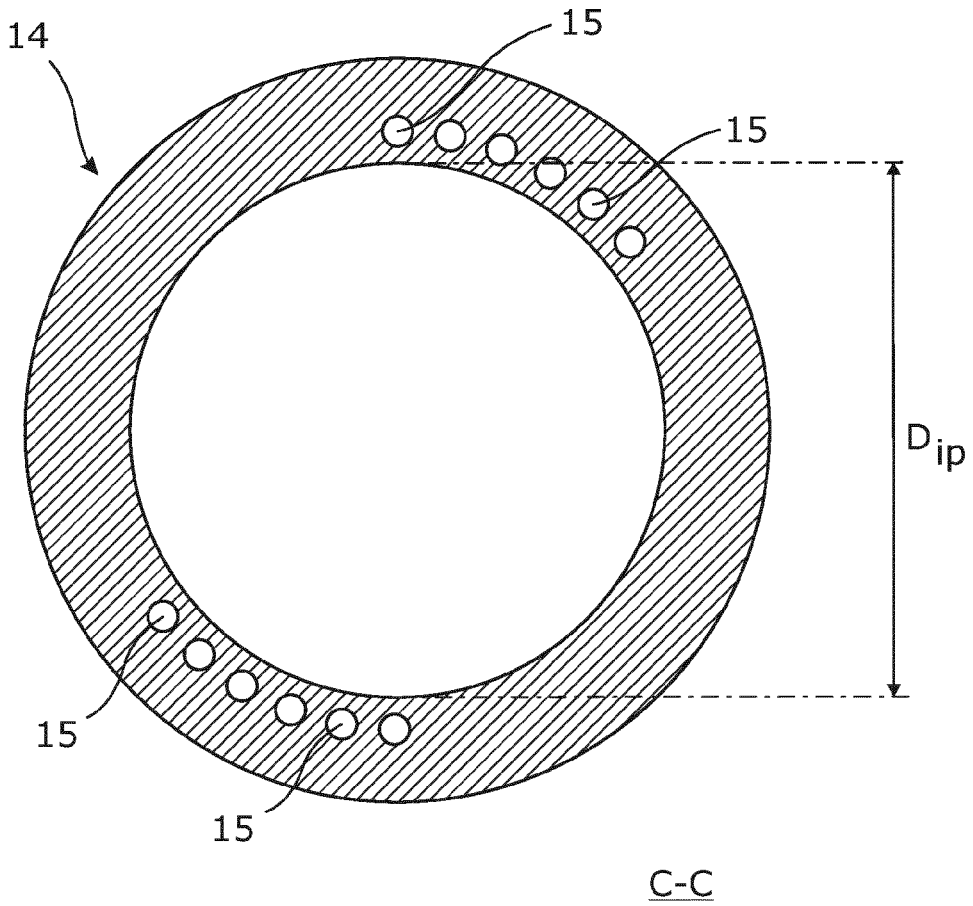
FIG. 3 shows a packer.

In FIG. 3, the packer 14 is shown in a cross-sectional view. The packer channels 15 are positioned in the same manner as the two groups of inlets as described in connection with FIG. 2.

Figure 4C:
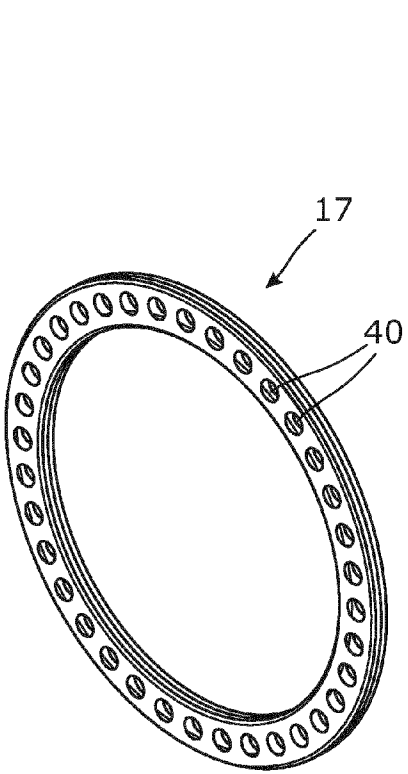
FIG. 4C shows the spring element in perspective.
Figure 4B:
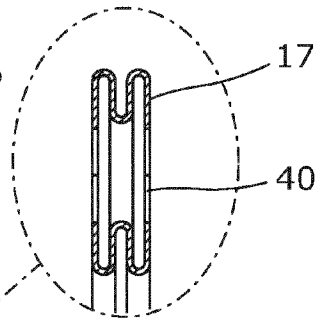
FIG. 4B shows an enlarged view B of FIG. 4B.
Figure 4A:
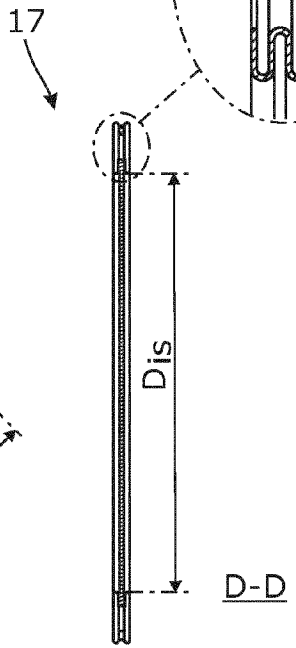
FIG. 4A shows a cross-sectional view of the spring element of FIG. 4 taken at A-A in FIG. 4.
Figure 4:
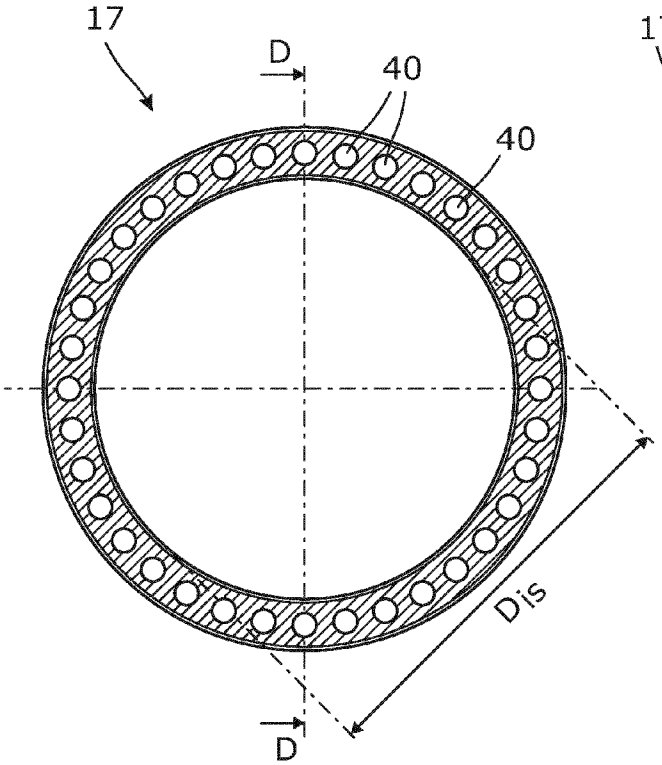
FIG. 4 shows a cross-sectional view of the spring element taken at B-B in FIG. 5.
Figure 5:
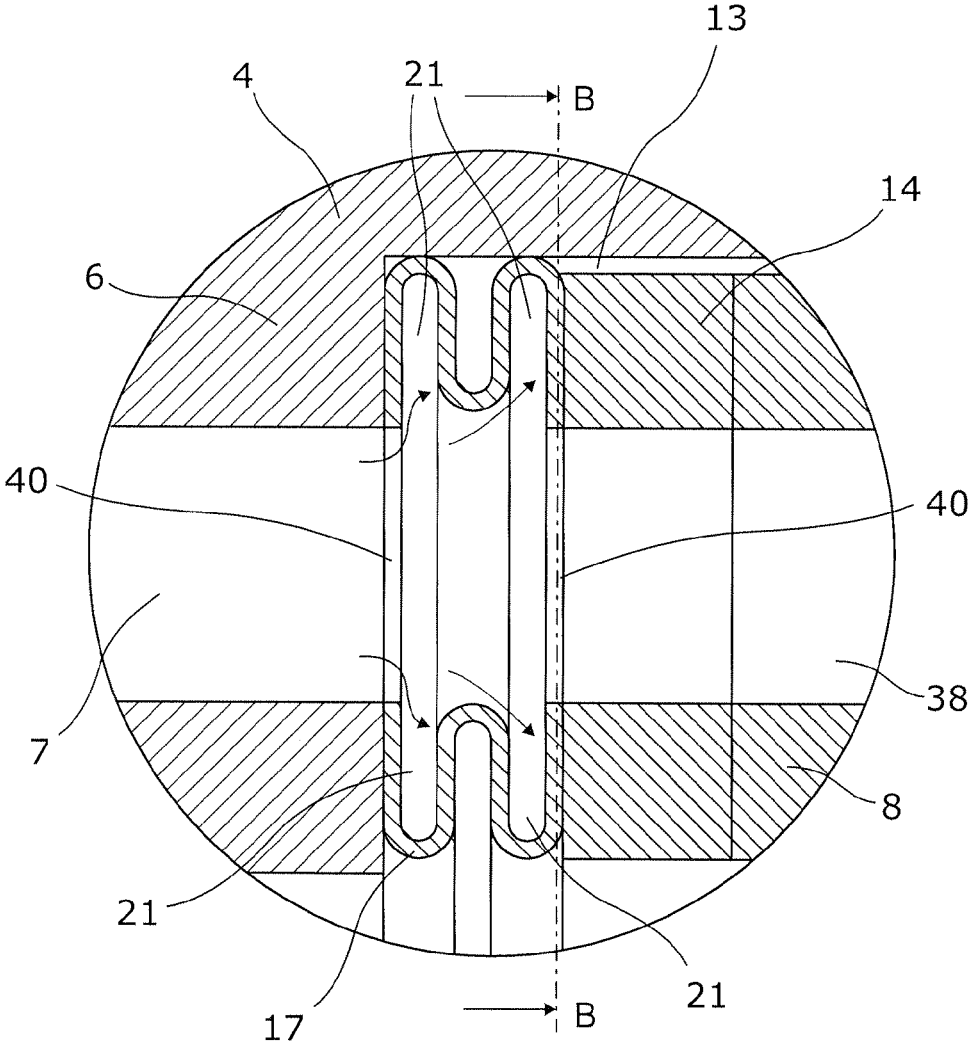
FIG. 5 shows an enlarged longitudinal cross-sectional view of the spring element.

FIGS. 4 and 5 show an embodiment of the spring element 17. In FIG. 4, the spring element 17 is shown in a cross-sectional view taken at B-B in FIG. 5.

FIG. 5 shows an enlarged longitudinal cross-sectional view of the spring element 17. The spring element 17 is positioned between the wall 6 of the first tubular 4 and the packer 14. The spring element 17 is placed in the same inner circumferential recess 13 as the packer 14 and the second tubular (not shown). Thus, the spring element is circular and is squeezed in between the first packer and the first tubular providing a sealing connection with both the first packer and the first tubular.

The spring element is ring-shaped having an inner spring diameter $D_{is}$ substantially equal to an inner diameter $D_i$ of the first tubular. The spring element 17 comprises a plurality of holes 40 for providing fluid communication between the first axial channel and the second axial channel. The spring element is fixedly connected with the first tubular 4 and is arranged between the first tubular and the packer and thereby connects the packer and the first tubular 4 so that the first axial channel, the holes in the first spring element 17 and the through-going packer channels 15 are aligned. Access of fluid from the reservoir is thus determined by the position of the second tubular in relation to the packer and thus the first tubular.

Thus, the holes of the spring element extend through the spring element along the axial extension of the first tubular.

The packer is also ring-shaped having an inner packer diameter $D_{ip}$ which is substantially equal to an inner diameter of the first tubular so that the inner diameter of the tubular is not decreased.

The spring element 17 is bellows-shaped as shown in FIGS. 4A, 4B, 4C and 5 and is preferably made of metal. The bellows-shaped spring element 17 comprises axial grooves 21, in which the fluid flow (indicated by the arrows) can force the spring element 17 against the packer 14, whereby the fluid flow and pressure exert an axial force on the packer 14 so that the packer is pressed against the second tubular (not shown), providing enhanced sealing properties. The bellows-shaped spring element has a first outer face abutting the first tubular, providing a sealing connection with the first tubular so that fluid flows in the first axial channel of the first tubular through the hole in the spring element.

Indeed, the spring element 17 has a surface area which is larger than a cross-section of the axial groove, which again results in the fluid pressure present in the first channel 7 exerting a force on the surface area whereby the force presses the packer 14 against the second tubular for enhancing the sealing.

Figure 6A:
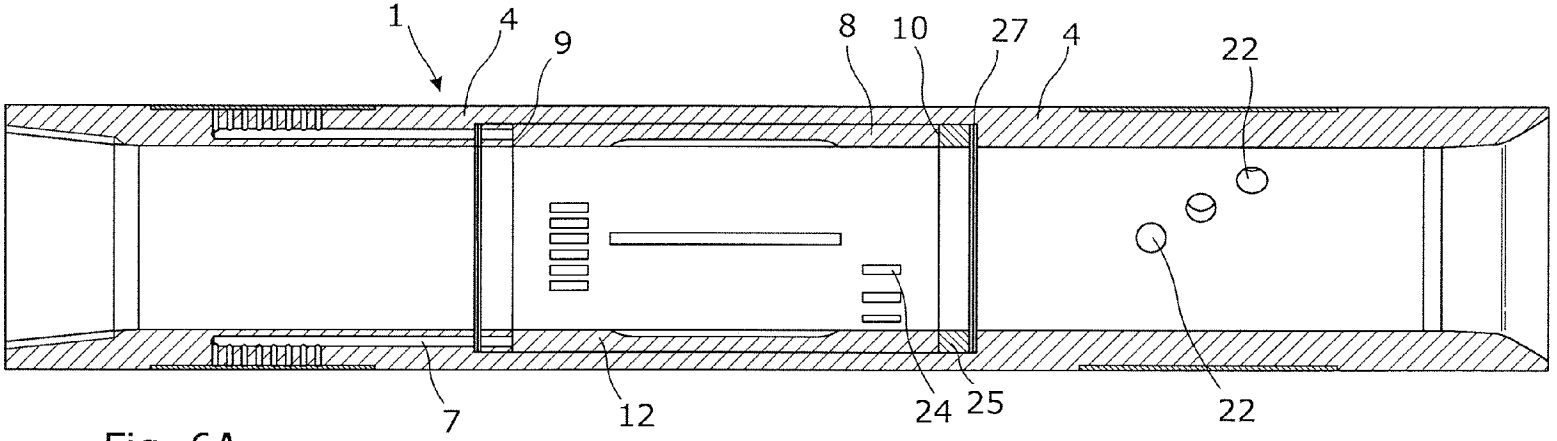
FIGS. 6*a* and 6*b* show longitudinal cross-sectional views of another embodiment of an inflow assembly according to the invention.
Figure 6B:
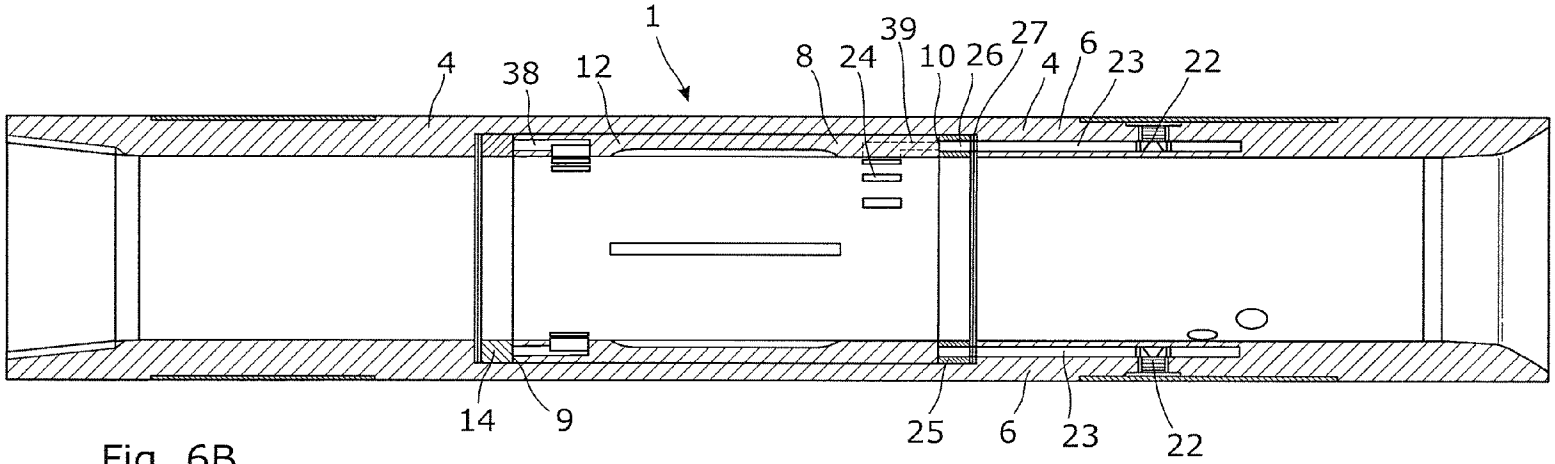

FIGS. 6*a* and 6*b* show two longitudinal cross-sectional views of another embodiment of an inflow assembly 1. The inflow assembly 1 is partly identical to the embodiment shown in FIG. 1. However, the first tubular 4 further comprises six second inlets 22 and six third axial channels 23 extending in the first wall 6 from the second inlets 22.

The second tubular 8 further comprises six second outlets 24 and has six fourth axial channels 39 extending in the second wall 12 from the second end 10. In this embodiment, the second tubular 8 is also rotatable in relation to the first tubular 4 at least between a first position (not shown), in which the third and fourth channels are in alignment for allowing fluid to flow from the reservoir into the casing via the second end 10 of the second tubular and a second position (the position shown in FIGS. 6*a* and 6*b*), in which the third and fourth channels are out of alignment so that fluid is prevented from flowing into the casing from the second end 10 of the second tubular 8.

As mentioned above in connection with FIG. 1, the left side of the inflow assembly 1 is also shown in the second position, in which the first and second channels are out of alignment so that fluid is prevented from flowing into the casing from the first end 9 of the second tubular 8.

The embodiment shown in FIGS. 6*a* and 6*b* has the advantage that one rotatable second tubular 8 may control inflow of fluid into the casing from more areas than the inflow assembly shown in FIG. 1. This is obtained by each end of the second tubular being aligned with inlets arranged in the first tubular 4 on each side of the second tubular 8.

Furthermore, both the inlets and the outlets as well as the intermediate channels may be arranged in the first tubular and second tubular, respectively, with predetermined distances between them around the periphery of the first and second tubulars, so that the operator of the inflow assembly 1 has the possibility of optionally choosing which inlets to open and which to close by rotating the second tubular 8 to the position in which the channels are in alignment. This is a further advantage if one or more of the inlets and/or outlets is/are clogged or blocked so that no fluid can enter. The operator then has the possibility of choosing another inlet.

In FIGS. 6*a* and 6*b*, a second packer 25 is arranged between the first tubular 4 and the second end 10 of the second tubular 8, the packer 25 having at least one through-going packer channel 26 aligned with the third axial channel 23. Again, the second packer 25 is preferably made of ceramics. Furthermore, a second spring element 27 is arranged between the second packer 25 and the first tubular 4 and has a design similar to that of the first spring element, described in connection with FIGS. 4 and 5 above.

In the shown inflow assembly, in which the first and second packers 14, 25 and the first and second spring elements 17, 27 are arranged on both sides of the second tubular 8, the fluid flow and thereby pressure flowing in the axial channels on both sides of the second tubular will exert axial forces on both sides of the second tubular 8, i.e. on the spring elements 17, 27 and thereby on the packers 14, 25, whereby enhanced sealing properties are provided on both sides of the second tubular 8. Even when the second tubular 8 is in a closed position (as shown in FIGS. 6*a* and 6*b*) at one end or both ends, the fluid flowing in through the inlets will still exert axial forces via the spring elements and the packers towards the second tubular 8. Thus, when the axial channels arranged at each end of the second tubular 8 are all in non-alignment with the axial channels of the first tubular, the fluid is at least stopped from flowing into the casing at these points. However, since the fluid at both ends of the second tubular still has a flow pressure, these pressures will exert axial forces at both ends of the second tubular, and will consequently force the packers towards the ends of the second tubular 8, whereby the inflow assembly obtains enhanced sealing around the second tubular 8, even when the flow of fluid has been stopped.

Moreover, the second inlets 22 have a valve arranged therein, preferably a constant flow valve or inflow control valve, which will be described briefly in connection with FIG. 7 below. Thus, the inlets on the left side of the second tubular 8 have flow restrictors arranged therein, and the inlets on the right side of the second tubular 8 have constant flow valves arranged therein. Thus, by means of the present invention it is possible for the operator to design the inflow assembly to the specific requirements by inserting the desired valves, restrictors and/or throttles in predetermined inlets.

Even though two specific embodiments have been described above, each having either twelve or six inlets, the first tubular may comprise a plurality of inlets and/or a plurality of first axial channels as required. Similarly, the second tubular 8 may comprise a plurality of second axial channels as well as outlets.

Figure 7:
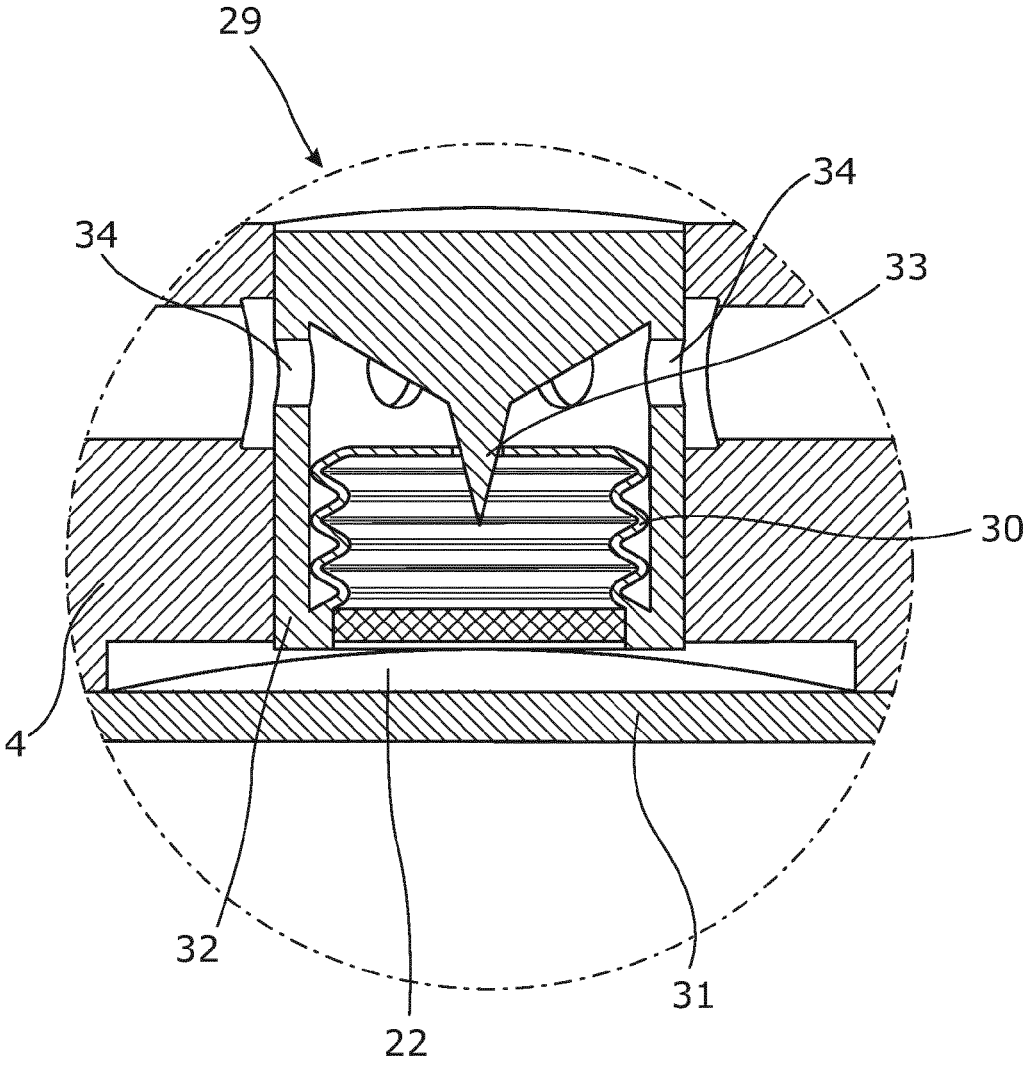
FIG. 7 shows a cross-sectional view of an embodiment of an inflow valve arranged in an inlet in the first tubular.

FIG. 7 shows one embodiment of an inflow control valve or a constant flow valve. In this embodiment, the inflow control valve 29 comprises a screen 31 arranged in the inlet 22 of a housing 32 and a spring element 30 in the form of a bellows. The housing 32 has a projection 33 tapering from the end of the housing 32 comprising the outlet 34 towards the inlet 22. The bellows have a valve opening (not shown) which the projection penetrates so that when the fluid flows in through the inlet 22 of the valve from the formation, the pressure of the fluid forces the bellows to extend, causing the valve opening to travel towards the outlets 34, and the valve opening decreases as the bellows travel due to the projection tapering and filling out part of the valve opening. In this way, high pressure caused from the fluid pressure in the formation decreases the valve opening, and thus the inflow of fluid is controlled. As the pressure in the formation drops, the bellows are retracted again and more fluid is let through the valve opening.

Several other designs of the inflow control valve may be incorporated into the inlets of the first tubular 4.

Figure 8:
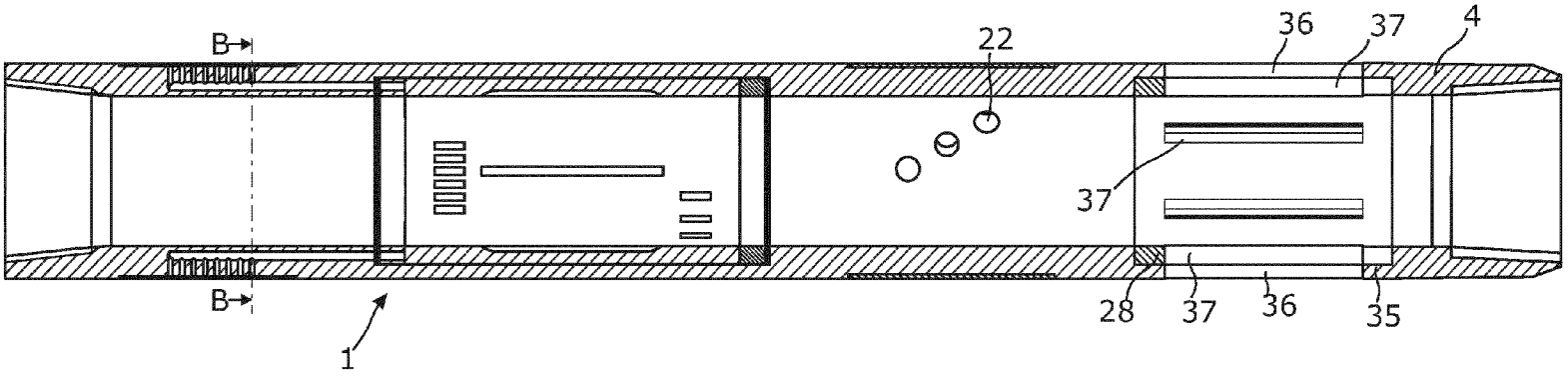
FIG. 8 shows a longitudinal cross-sectional view of another embodiment of an inflow assembly further comprising a third tubular.

Another embodiment of an inflow assembly 1 is shown in FIG. 8. The inflow assembly 1 in this embodiment comprises the same features as the embodiment shown in FIGS. 6*a* and 6*b*. In addition to these features the inflow assembly also comprises a third tubular 28, which is rotatable within the first tubular 4. The third tubular 28 is rotatable in an inner circumferential recess 35 arranged in the first tubular 4. The first tubular comprises a number of first openings 36 in the form of axial longitudinal grooves. The third tubular 28 also comprises the same number of second openings 37 as the first tubular 4.

The third tubular 28 is rotatable in relation to the first tubular 4 at least between a first position in which the first and second openings 36, 37 are in alignment for allowing access through the openings 36, 37 and a second position in which the first and second openings 36, 37 are out of alignment so that access through the third tubular 28 is impossible.

In this embodiment, the third tubular 28 is arranged to the right of the second inlets 22 of the first tubular 4. However, it may as well be arranged to the left of the first inlets 5.

The third tubular 28 may for instance be a fracturing port or a rotational sleeve fracturing valve.

Thus, according to the inventive idea, the inflow assembly may comprise a plurality of additional features or elements, which may be incorporated for fulfilling different purposes and requirements. Accordingly, the inflow assembly may have multiple functionalities.

Figure 9A:
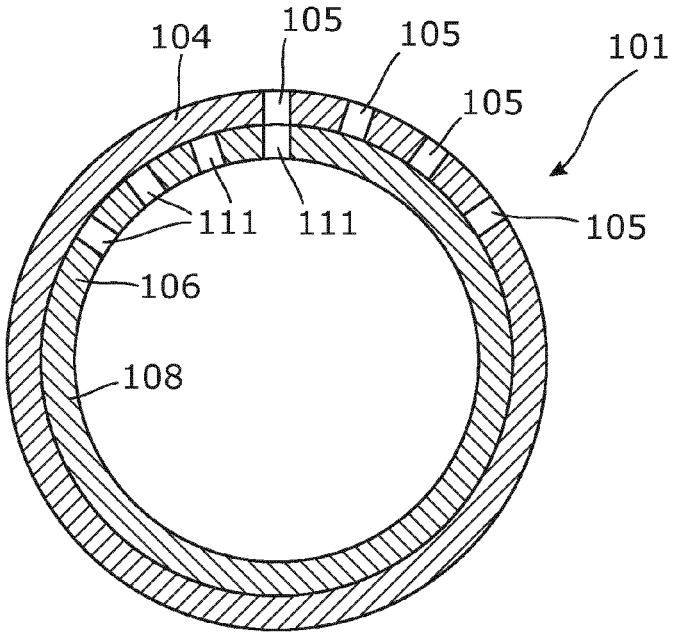
FIGS. 9*a* and 9*b* show cross-sectional views of an additional inflow assembly according to another aspect of the present invention.
Figure 9B:
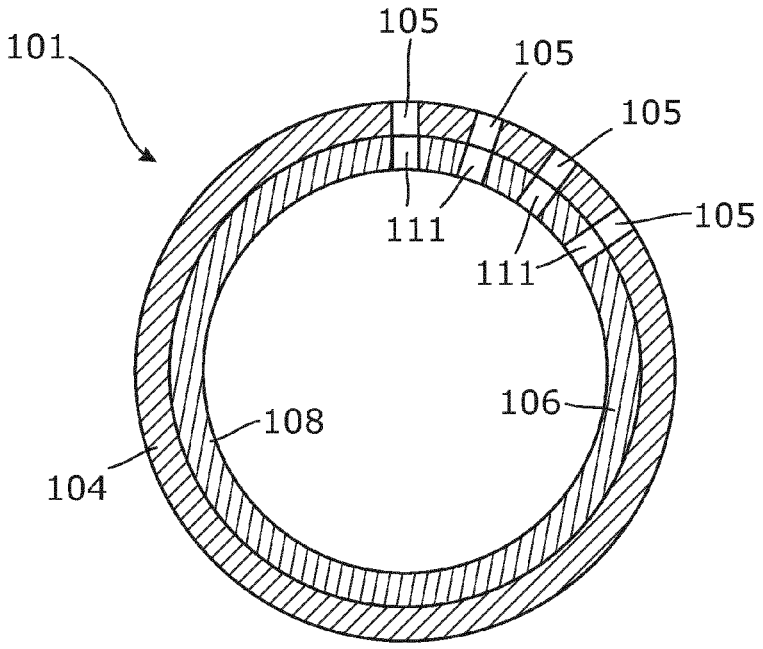

In another aspect according to the invention, which is shown in FIGS. 9*a* and 9*b*, an inflow assembly 101 for controlling fluid flow between a hydrocarbon reservoir and a production casing in a well comprises a first tubular 104 which in this embodiment has four inlets 105.

Furthermore, the inflow assembly 101 comprises a second tubular 108 which is rotatable within the first tubular 104 and has a wall 106 and, in this embodiment, four outlets 111 penetrating the wall 106.

According to the inventive idea, the second tubular 108 is rotatable from a first position (the position shown in FIG. 9*a*) in which the outlets 111 are aligned with at least one of the inlets 105, and the wall 106 is opposite the other inlets, to a second position (not shown) in which the one or more outlet(s) 111 may be aligned with one or more of the second inlets, and the wall is opposite the first inlet, or to a third position (not shown) in which the wall is opposite the first and the second inlets.

Thus, it is obtained that one or more inlets in the first tubular 104 may be aligned with one or more outlets in the second tubular 108, or even be in non-alignment whereby the inflow assembly is closed for inflow of fluid. The operator may then easily rotate the second tubular 108 so that the desired inflow of fluid matching the specific requirements is obtained.

In FIG. 9*b* it is shown that all four inlets 105 and outlets 111 are in alignment, and hence all open for inflow.

According to the aspect of the present invention, the first tubular will always at least comprise a first and a second inlet, and the second tubular 108 will also at least comprise a first outlet. Also, even though the present embodiment shows four inlets and outlets, respectively, the first tubular may comprise a plurality of inlets and the second tubular comprises a plurality of outlets so that several inlets and outlets can be in alignment.

In this embodiment, the inlets are shown as openings. However, the openings may comprise flow restrictors, throttles or valves, such as inflow control valves as described in connection with FIG. 7 above.

Furthermore, the second tubular may comprise at least one recess (not shown) accessible from within, the recess being adapted to receive a key tool for rotating the second tubular.

In addition, the present invention also relates to a downhole completion (not shown) which comprises a casing string and one or more of the inflow assembly/assemblies having the features described above.

Although the invention has been described in the above in connection with preferred embodiments of the invention, it will be evident for a person skilled in the art that several modifications are conceivable without departing from the invention as defined by the following claims.

The invention claimed is:

1. An inflow assembly, comprising:

a first tubular having an axial extension along a longitudinal axis and at least one inlet of the first tubular, the first tubular having a first wall within which at least a first axial channel extends from the inlet parallel to the longitudinal axis of the first tubular;

a second tubular having a first longitudinal end, a second longitudinal end, and at least one outlet, the second tubular being rotatable within the first tubular, the second tubular having a second wall within which at least a second axial channel extends from the first longitudinal end to the outlet parallel to the longitudinal axis of the first tubular;

wherein the second tubular is configured to rotate at least between a first position in which the first and second axial channels are axially aligned and in fluid communication and a second position in which the first and second axial channels are out of alignment and out of fluid communication; and the inflow assembly is configured to control fluid flow between a hydrocarbon reservoir and a production casing in a well.

2. The inflow assembly according to claim 1, wherein a first packer is arranged between the first tubular and the first longitudinal end of the second tubular, the packer having at least one through-going packer channel aligned with the first axial channel.

3. The inflow assembly according to claim 2, wherein the first packer is made of ceramics.

4. The inflow assembly according to claim 2, wherein a first spring element is arranged between the first packer and the first tubular.

5. The inflow assembly according to claim 4, wherein the spring element is bellows-shaped.

6. The inflow assembly according to claim 5, wherein the bellows-shaped spring element comprises recesses, in which the fluid flow can force the spring element against the packer.

7. The inflow assembly according to claim 1, wherein the first tubular has a second inlet and a third axial channel extending in the first wall from the second inlet, the second tubular having a second outlet and having at least a fourth axial channel extending in the second wall from the second longitudinal end, the second tubular being rotatable in relation to the first tubular at least between a first position, in which the third and fourth channels are in alignment for allowing fluid to flow from the reservoir into the casing via the second longitudinal end of the second tubular and a second position, in which the third and fourth channels are out of alignment so that fluid is prevented from flowing into the casing from the second longitudinal end of the second tubular.

8. The inflow assembly according to claim 7, wherein a second packer is arranged between the first tubular and the second longitudinal end of the second tubular, the packer having at least one through-going packer channel aligned with the third axial channel.

9. The inflow assembly according to claim 8, wherein a second spring element is arranged between the second packer and the first tubular.

10. The inflow assembly according to claim 1, wherein the first tubular comprises a plurality of inlets and a plurality of first axial channels.

11. The inflow assembly according to claim 1, wherein the second tubular comprises a plurality of second axial channels.

12. The inflow assembly according to claim 1, wherein the second tubular comprises at least one recess accessible from within, the recess being adapted to receive a key tool for rotating the second tubular.

13. A downhole completion comprising a casing string and at least one of the inflow assembly according to claim 1.

* * * * *